United States Patent [19]

Lindeboom

[11] 4,126,004

[45] Nov. 21, 1978

[54] FRICTION ROCK STABILIZER

[75] Inventor: Herman Lindeboom, Ringoes, N.J.

[73] Assignee: Ingersoll-Rand Company, Woodcliff Lake, N.J.

[21] Appl. No.: 821,738

[22] Filed: Aug. 4, 1977

[51] Int. Cl.[2] ..... E21D 21/00; E21D 20/00

[52] U.S. Cl. ..... 405/259; 85/8.3; 405/303

[58] Field of Search ..... 61/45 B, 45 R, 63; 85/8.3, 84, 32.1, 80

[56] References Cited

U.S. PATENT DOCUMENTS

| | | | |
|---|---|---|---|
| 2,702,490 | 2/1955 | Launder | 85/8.3 |
| 3,557,402 | 1/1971 | Koehl | 85/8.3 X |
| 3,905,270 | 9/1975 | Hehl | 85/8.3 X |
| 3,922,867 | 12/1975 | Scott | 61/45 B |

FOREIGN PATENT DOCUMENTS

| | | | |
|---|---|---|---|
| 559,858 | 1/1958 | Canada | 85/8.3 |

*Primary Examiner*—Dennis L. Taylor

*Attorney, Agent, or Firm*—Bernard J. Murphy

[57] ABSTRACT

The stabilizer comprises an elongate element which is axially slit, and is circular in cross-section, for forced insertion into an undersized bore in a structure, such as a mine roof or wall, for stabilizing the structure. The stabilizer improvement comprises an annular, wire-rod flange made integral therewith for reinforcing the driven end of the stabilizer to enable such end to accept impact forces upon the stabilizer being forced into the bore.

12 Claims, 8 Drawing Figures

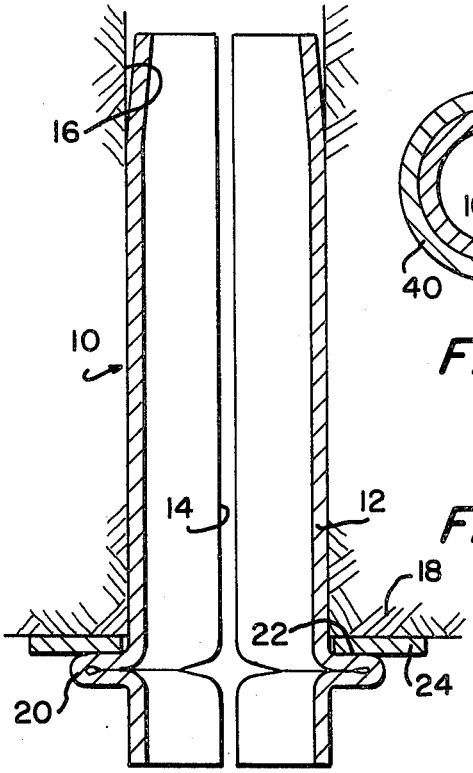
FIG. 1
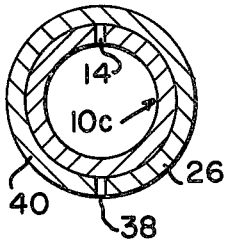
FIG. 8
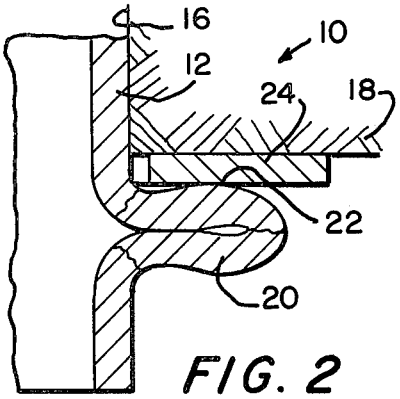
FIG. 2
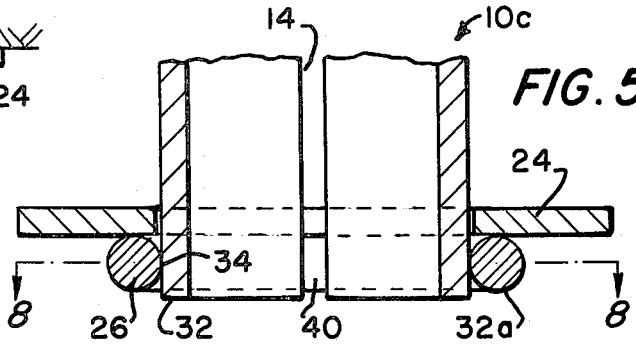
FIG. 5
FIG. 3
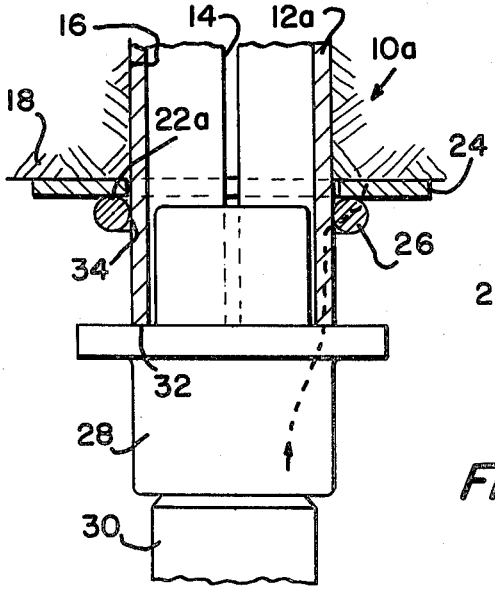
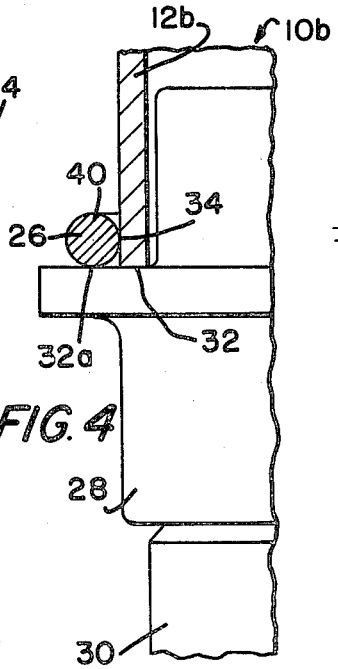
FIG. 4
FIG. 6
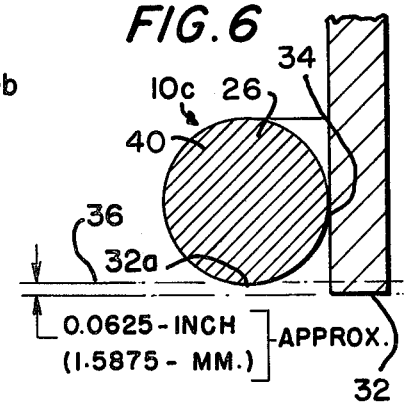
FIG. 7
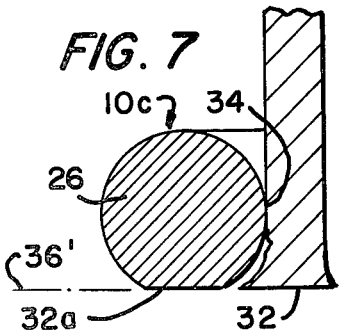

FRICTION ROCK STABILIZER

This invention pertains to friction rock stabilizers and in particular to an improved friction rock stabilizer for forced insertion thereof into an undersized bore in an earth structure, such as a mine roof or wall, for stabilizing the structure, having means for reinforcing the driven end of the stabilizer so that the same can more readily accept insert forces addressed thereto.

Rock stabilizers are known in the prior art and are exemplified by U.S. Pat. Nos. 3,349,567, issued Oct. 31, 1967, to J. E. Munn, for "Mine Roof Support and Method of Providing Same", and also 3,922,867, issued Dec. 2, 1975, and 4,012,913, issued Mar. 22, 1977, both said latter patents having been issued to James J. Scott, and both patents being for "Friction Rock Stabilizers".

The stabilizer or roof support bolt disclosed by patentee Munn is, as shown in FIG. 3 of his patent, inserted into an oversized bore and expanded, according to his invention, into engagement with the surface of the bore. The stabilizers disclosed by Scott in his patents comprise generally annular bodies which are longitudinally slit so that the same will yield under circumferential compression to accommodate a forced insertion thereof into an undersized bore. The slit stabilizers, in that they are axially divided, have a tendency to fail, when forceably inserted into a structure bore by a stabilizer driver, such driver normally being impacted by a piston. Especially is this so if the stabilizer is not axially aligned with the bore hole, and/or if the driver is also canted with respect to the terminal, driven end of the stabilizer. The slit, provided to accommodate a reduction of the cross-sectional dimension of the stabilizer, opens up and the stabilizer end bends and becomes splayed.

It is an object of this invention, therefore, to set forth an improved friction rock stabilizer which avoids the aforementioned difficulty. It is particularly an object of this invention to set forth an improved friction rock stabilizer for forced insertion thereof into an undersized bore in an earth structure, such as a roof or wall of a mine shaft or tunnel, for stabilizing the structure, said stabilizer comprising a hollow elongate body formal of a single wall which, in cross-section, is substantially annular, and which body has means extending generally lengthwise, from one end thereof for at least half the length thereof, responsive to circumferential compression of said body, arising from such forced insertion thereof into such a structure bore, to cause at least a portion of said body to assume a diminished periphery to accommodate such forced insertion, and to cause said body frictionally to engage the surface of such a structure bore to stabilize the structure, the improvement comprising means made integral with said one end of said body for reinforcing said end to accept bore-insertion forces addressed to said stabilizer and for fixing a support plate against the structure.

Further objects of this invention as well as the novel features thereof will become more apparent by reference to the following description taken in conjunction with the accompanying Figures in which:

FIG. 1 is a longitudinally cross-sectioned view of an experimental type of stabilizer;

FIG. 2 is an enlarged, fragmentary view of the stabilizer of FIG. 1 showing the annular, radial-fold flange;

FIG. 3 is a partial, longitudinally cross-sectioned view of an alternative and experimental embodiment of a stabilizer having a wire-rod annulus fixed thereto some distance from the driven end of the stabilizer; and FIGS. 4 through 8 illustrate, in cross-sectional views, embodiments of the improved friction rock stabilizer according to the invention.

As shown in FIGS. 1 and 2, a typical friction rock stabilizer 10 comprises an elongate body 12, of circular or annular cross-section, which has an axial slit 14 to accommodate circumferential compression in order that the same might be forced into an undersized bore 16 of a structure 18 such as a mine roof (or the like). Experimentation done on such stabilizers 10, to stiffen the same, has comprised the embodiment shown (FIGS. 1 and 2). Such embodiment has been formed by folding back an intermediate portion of the stabilizer wall to define thereby an annular rib or flange 20. The purpose here was to reinforce the lower end of the stabilizer 10, and also to present a bearing surface 22 for fixing a support plate 24 against the structure 18. However, it has been found that this practice is quite unsatisfactory in that failures of the rib or flange 20 occurred. As shown in FIG. 2, the folded flange 20 fractures and breaks loose and, accordingly, the stabilizer 10 is not reinforced or stiffened, neither will it carry a support plate 24 in position against the structure 18.

By further experimentation it was found that a more suitable arrangement, as shown in FIG. 3, comprises the welding of a wire-rod annulus 26 to the external surface of the stabilizer body **12*a* to reinforce the driven end thereof (for the forced insertion of the stabilizer 10*a* into a bore). Additionally, the wire-rod-formed annulus 26 presents the necessary bearing surface 22*a* for the support plate 24. However, unless the insertion of the friction rock stabilizer 10*a* is monitored and controlled very closely, it can be appreciated that when the support plate 24 is closing upon the structure 18, the impacting force of the stabilizer driver 28, proceeding from the impacting piston 30, is taken through the end 32 of the stabilizer and through the wire-rod weld 34. As a result, the wire-rod annulus 26 also is broken away from the stabilizer 10*a***.

According to an embodiment of the invention, an improved friction rock stabilizer **10*b*, shown in FIG. 4, carries the wire-rod annulus 26 at the very end of the stabilizer, so that the lowermost surface 32*a* of the annulus 26 is exactly coplanar with the terminal end 32 of the stabilizer 10*b*. As a practical matter, this is difficult or unduly expensive to arrange in manufacturing. Accordingly, the optimum arrangement is that shown in the embodiment of FIGS. 5 and 6 (the latter being greatly enlarged) where the wire-rod annulus 26 is slightly recessed from the end 32 of the stabilizer 10*c*. The recess is in the order of 0.0625 inch (1.5875 mm). Now then, upon the stabilizer 10*c* initially being forced into a bore 16, the impacting force is taken on the end 32 of the stabilizer 10*c*. During insertion, as shown in FIG. 7 (of the scale of FIG. 6), end 32 begins to "mushroom" to where it proceeds to assume a common plane 36 with the lowermost surface 32*a* of the wire-rod annulus 26. Then, the impacting force is taken commonly by the wire-rod annulus 26 and the annular end 32 of the stabilizer 10*c*; in fact, the wire rod itself will begin to flatten, but there is no risk of a force being addressed to the annulus 26 which will break open the weld 34. The flattening surfaces 32 and 32*a* simply proceed to subsist in a yet more removed plane 36' (FIG. 7**).

It is possible, of course, for the support plate 24 to come into engagement with the structure 18 before the end 32 of the stabilizer 10*c* has flattened into co-planar relationship with surface 32*a* of the annulus 26. Yet, it has been found that the optimum or nominal dimension of the recess (i.e., 0.0625 inch; 1.5875 mm) is such as to allow any necessary and slight displacement of the annulus 26 without breaking the weld 34. The dimension is recited as being "optimum" or "nominal" for, clearly, a same difficulty or expense would arise in endeavoring to hold to the measurement, precisely, in manufacture. Actually, the dimension is approximated, and about the circumference of the annulus 26, from place to place, the dimension may be found to be slightly greater, or slightly less and, in fact, locations along surface 32*a* may be found to be co-planar with stabilizer end 32. On balance then, the slight, nominal recess of the annulus 26 does not jeopardize the weld 34 thereof. What is important is to insure that surface 32*a* of the annulus 26 does not overhang stabilizer end 32.

The embodiments shown and described comprise the employment of a length of wire rod which envelops the lowermost portion of the stabilizer 10*b* or 10*c*. In an alternate embodiment, it will be possible, of course, to fold the lower end 32 of the stabilizer back upon itself to define thereof a "cuffed", reinforced end.

In the employment of the wire-rod annulus 26, and to facilitate circumferential reduction of the terminal end 32 of the stabilizer 10*b* or 10*c* a separation 38 at the ends of the wire rod 40 would be aligned with the slit 14 of the stabilizer. However, this does not provide all the reinforcement which is possible, and the aligned slit 14 and separation 38 will provide a non-resisting path for a canted driver 38. Accordingly, the better practice is to arrange for the wire rod separation 38 and the slit 14 in the stabilizer 10*c* to be 180° out of phase from each other, as shown in FIG. 8.

While I have described my invention in connection with specific embodiments thereof, it is to be clearly understood that this is done only by way of example, and not as a limitation to the scope of my invention as set forth in the objects thereof and in the appended claims.

I claim:

1. An improved friction rock stabilizer for forced insertion thereof into an undersized bore in an earth structure, such as a roof or wall of a mine shaft or tunnel, for stabilizing the structure, said stabilizer comprising a hollow, elongate body formed of a single wall which, in cross-section, is substantially annular, which body has means extending generally lengthwise, for at least half the length thereof, responsive to circumferential compression of said body, arising from such forced insertion thereof into such a structure bore, to cause at least a portion of said body to assume a diminished periphery to accommodate such forced insertion, and to cause said body frictionally to engage the surface of such a structure bore to stabilize the structure, and which body has a driven end with a terminal, impact surface thereat for accepting bore-insertion forces thereupon, wherein the improvement comprises means made integral with an external surface of said driven end of said body for reinforcing said driven end to accept bore-insertion forces addressed thereto and for fixing a support plate against the structure, said reinforcing means is slightly spaced from said terminal, impact surface to isolate said reinforcing means from bore-insertion forces addressed to said impact surface at least during a principal portion of bore-insertion of said stabilizer, whereby upon said reinforcing means closing upon a support plate, or a surface of an earth structure in which said stabilizer is forceably inserted, said reinforcing means and said terminal, impact surface merge toward a position in which said reinforcing means and said terminal, impact surface can accept bore-insertion forces in common.

2. An improved friction rock stabilizer, according to claim 1, wherein:

said compression-responsive means comprises a throughgoing split formed in said body to permit edge portions of said body, which are defined by said split, to effect relative movement therebetween.

3. An improved friction rock stabilizer, according to claim 1, wherein:

said body has a first end, for forced movement thereof into a structure bore, and a second end to which insertion forces are addressed to move said first end into a bore; and said reinforcing means is made integral with said second end.

4. An improved friction rock stabilizer, according to claim 1, wherein:

said driven end of said body comprises means defining a bearing surface formed of internal and external surfaces of said body;

said bearing surface lying in a plane normal to the periphery of said body; and said reinforcing means is made integral with one of said internal and external surfaces.

5. An improved friction rock stabilizer, according to claim 4, wherein:

said reinforcing means is made integral with said external surface.

6. An improved friction rock stabilizer, according to claim 5, wherein:

said reinforcing means has a surface lying in said plane.

7. An improved friction rock stabilizer, according to claim 5, wherein:

said reinforcing means has a surface lying in a plane which is spaced apart from, and substantially parallel to, said normal plane.

8. An improved friction rock stabilizer, according to claim 7, wherein:

said substantially parallel and normal planes are spaced apart approximately 0.0625 inch (1.5875 mm).

9. An improved friction rock stabilizer, according to claim 7, wherein:

said substantially parallel plane is recessed from said normal plane approximately 0.0625 inch (1.5875 mm).

10. An improved friction rock stabilizer, according to claim 5, wherein:

said reinforcing means comprises a length of wire rod which is welded to said external surface.

11. An improved friction rock stabilizer, according to claim 10, wherein:

said length of rod envelops said external surface, save for a minor portion thereof, ends of said rod defining a minor separation therebetween.

12. An improved friction rock stabilizer, according to claim 11, wherein:

said compression-responsive means comprises a throughgoing split formed in said body to permit edge portions of said body, which are defined by said split, to effect relative movement therebetween; and said minor separation is disposed in a postion which is taken from a range of from 45 to 180° of arc from said split.

* * * * *